United States Patent [19]

Barac

[11] 3,985,082

[45] Oct. 12, 1976

[54] ELECTRIC WALKER

[76] Inventor: Dragoje R. Barac, 639 Shatto Place, Los Angeles, Calif. 90005

[22] Filed: Apr. 2, 1975

[21] Appl. No.: 564,487

[52] U.S. Cl. ..... 104/89; 104/62; 105/148; 128/25 R; 272/70

[51] Int. Cl.[2] ..... B61B 3/02

[58] Field of Search ..... 104/1 R, 62, 89, 91, 104/94, 95; 105/148, 150; 272/70, 70.3, 70.4; 128/25 R; 35/29 R, 29 C; 119/96

[56] References Cited

UNITED STATES PATENTS

| | | | |
|---|---|---|---|
| 2,871,915 | 2/1959 | Hogan | 272/70 |
| 3,495,720 | 2/1970 | Mann, Jr.; et al. | 104/91 X |
| 3,529,819 | 9/1970 | Blank | 272/70 |
| 3,780,663 | 12/1973 | Pettit | 104/1 R |
| 3,800,707 | 4/1974 | Hermann | 104/94 |
| 3,814,023 | 4/1974 | Stantial | 104/94 |
| 3,877,421 | 4/1975 | Brown | 128/25 R |

FOREIGN PATENTS OR APPLICATIONS

| | | | |
|---|---|---|---|
| 20,327 | 9/1912 | United Kingdom | 104/89 |

*Primary Examiner*—Robert J. Spar
*Assistant Examiner*—Randolph A. Reese
*Attorney, Agent, or Firm*—Ralph B. Pastoriza

[57] ABSTRACT

The ceiling of a room is provided with an overhead track along which a carriage can move. A vertical column extends from the carriage and terminates short of the floor in the room in a handle grip which may be held by a patient. Motors in the carriage serve to drive the carriage along the track and thus aid the patient in walking along the direction of the track. A second motor raises and lowers the handle grip to a convenient level so that different sized patients can use the walker.

5 Claims, 5 Drawing Figures

ELECTRIC WALKER

This invention relates generally to therapeutic devices used in rehabilitation and more particularly to an electrically operated walker for aiding crippled persons or patients in learning to walk or in actually walking from one room to another.

BACKGROUND OF THE INVENTION

In hospitals, veterans' rehabilitation centers, and similar medical therapeutic establishments, a large proportion of time is spent in teaching patients to walk or if they have walked at one time to reteach them to walk. For example, in the rehabilitation of hemiplegics, paraplegics as well as patients afflicted with cerebral palsy, multiple sclerosis, muscular dystrophy, osteogenesis imperfecta, Guillain-Barre syndrome, Parkinson's disease and severe rheumatoid arthritic conditions, all at one time or another need to learn to walk if possible. The same is true of post-operative patients, particularly those with orthopedic problems.

Substantial time is spent by therapists helping to support a person to walk a few steps each day. In such therapy, the therapist must gauge by "feel" of the patient's weight, how much force to exert in aiding the patient to walk and also gauge the proper speed of which the patient is capable. Return of self-confidence in being able to walk is oftentimes difficult under the best conditions.

In addition to the foregoing problems with medical patients, there are many elderly people who have difficulty in walking around in their own homes. While wheelchairs are available, if an elderly person is capable of walking at all, it would be desirable to encourage such walking to avoid the elderly person constantly having to lower or raise himself from a chair or sitting position.

BRIEF DESCRIPTION OF THE PRESENT INVENTION

With the foregoing considerations in mind, the present invention contemplates an electro-mechanical device in the form of an electric walker which can be wholly operated by a patient or elderly person to aid him in walking along a given path or route.

Briefly, the invention includes an overhead track secured above a given path along which a patient or elderly person would walk. A carriage structure in turn is coupled to the track for movement along the track. Column means is secured at its upper end to the carriage structure and extends vertically downwardly to terminate at its lower end in support means at a selected level above the path. With this arrangement, a patient or elderly person may be supported by the support means while walking along the path.

In the preferred embodiment of the invention, electric motors are provided to move the carriage along the track, the speed of movement being controlled by the motor which in turn is under control of the patient or elderly person. Further, the column structure is preferably comprised of telescoping members which may be raised or lowered by a second motor under control of the patient or elderly person.

With the foregoing arrangement, the electric walker can be adjusted in height above the floor so as to be useful for different persons of different heights as well as small children. Further, since the device can be wholly operated by the patient or elderly person himself, he can control the duration of the walking exercise as well as the speed of the walk. There is thus a psychological tendency for self-confidence to return much more rapidly than is the case when an assistant or other therapist must spend time helping the patient.

BRIEF DESCRIPTION OF THE DRAWINGS

A better understanding of this invention will be had by now referring to the accompanying drawings in which.

DETAILED DESCRIPTION OF THE INVENTION

Figure 1:
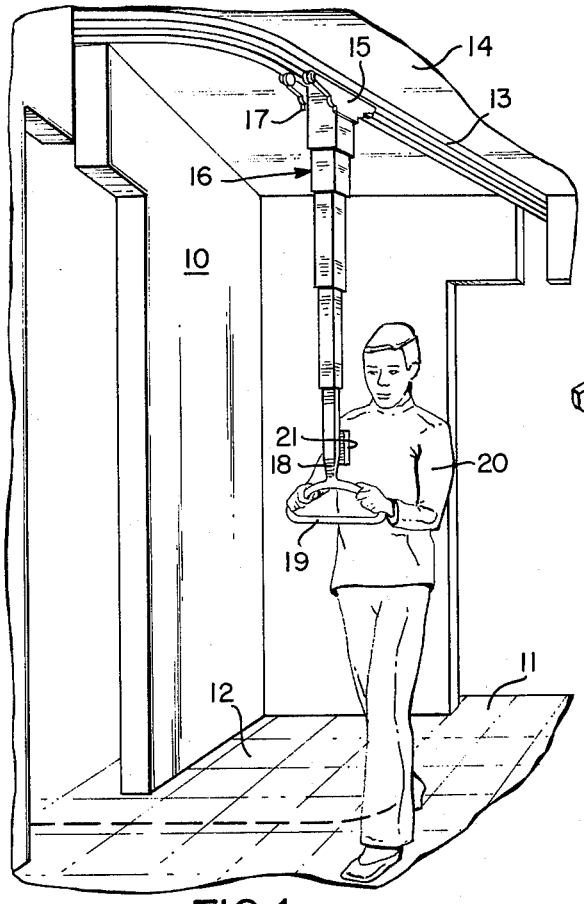
FIG. 1 is a broken away perspective view of a room incorporating the electric walker of this invention.

Referring first to FIG. 1 there is shown a portion of a room 10 wherein a given walk path is represented by the dashed line 11 on the floor 12 of the room. An overhead track 13 in turn is secured to the ceiling 14 of the room in a position vertically above the path 11 and following the direction of this path.

A carriage structure 15 is coupled to the overhead track 11 for movement along the track. A column means 16 in turn has its upper end secured to the carriage as at 17 and extends vertically downwardly to terminate at its lower end 18 in a support means 19, at a selected level above the floor of the room or the path 11.

As will become clearer as the description proceeds, the column means 11 is preferably telescoping so that the height of the support 19 can be adjusted to suit a particular patient or elderly person. In FIG. 1 there is shown a patient 20 gripping the support 19 which has been adjusted to a convenient level to support and aid the patient 20 in walking along the path 11.

As will also become clearer as the description proceeds, the carriage 15 incorporates a motor which may be manually energized and its speed controlled by a control box 21 secured to the lower end portion 18 of the column in a convenient position for operation by the patient 20.

With the foregoing arrangement, the patient can readily grip the support 19 and be aided in walking along the path 11.

Figure 2:
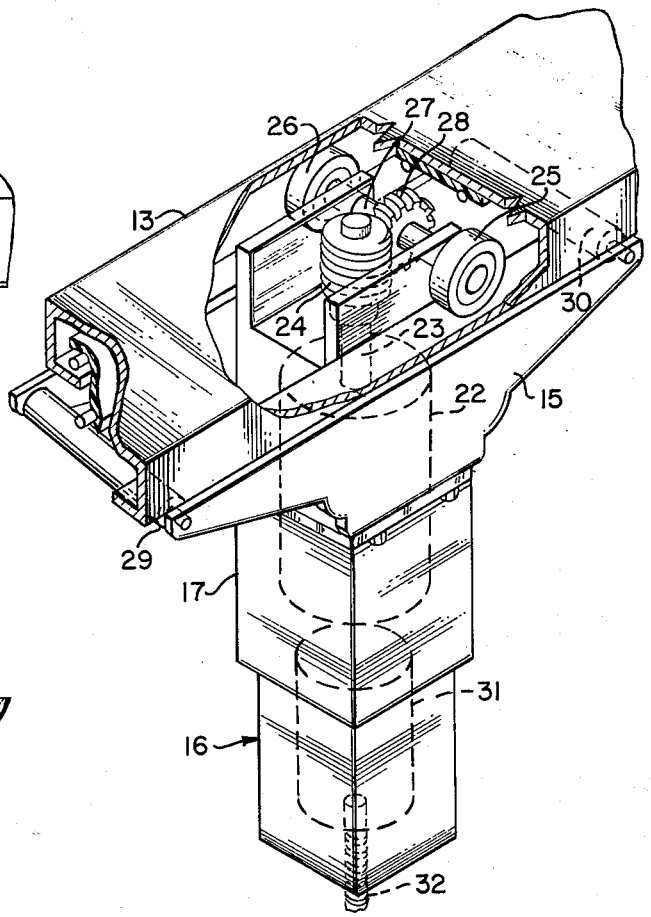
FIG. 2 is an enlarged broken away perspective view of an upper portion of the electric walker of FIG. 1.

Referring now to FIG. 2, the motor supported within the carriage 15 is shown at 22 and includes a shaft 23 terminating in a worm gear 24. The carriage itself is coupled to the track 13 by rollers 25 and 26 in spaced horizontal relationship. A shaft 27 connects between these rollers and is secured to the rollers for rotation therewith. A spur gear 28 is secured to the central portion of the shaft and is in meshing engagement with the worm gear 24.

The motor 22, hereafter referred to as a first motor, constitutes a reversible electric motor of the variable speed type so that when energized it will drive the entire carriage 15 and associated supported column 16 in one direction or the other along the track 13.

In order to stabilize movement of the carriage 15, it is preferably provided with small idler rollers 29 and 30 at its fore and aft ends as shown in FIG. 2, these rollers engaging the underside of the track 13 in opposition to the drive rollers 25 and 26.

In FIG. 2, there is also shown a second electric motor 31 which is of the reversible type and may also be of variable speed supported in the carriage 15 below the first motor 22. Second motor 31 includes a threaded shaft 32 surrounded by the telescoping column 16.

Figure 3:
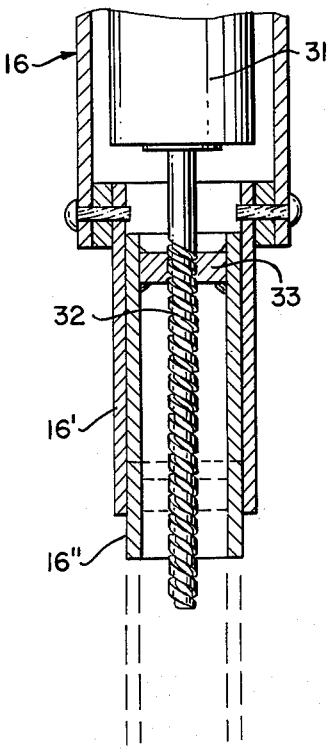
FIG. 3 is a fragmentary cross section of a central portion of the walker of FIG. 1.

With particular reference to the lower portion of the telescoping column as shown in cross section in FIG. 3, this column structure includes a first hollow elongated member 16′ fixed relative to the carriage and extending downwardly in surrounding relationship to the threaded shaft 32. At least one additional hollow elongated member 16″ is telescopically received in the lower end of the first member 16′ to also surround the threaded shaft 32. A travelling nut 33 in turn is threaded on the threaded shaft and secured to the additional member 16″ so that rotation of the threaded shaft 32 in one direction or the other will extend or retract the additional member 16″ relative to the first member 16′.

As will be evident from both FIGS. 2 and 3, the members making up the telescoping column structure are of square cross section so that they are keyed against rotation relative to each other. By this arrangement, the orientation of the support 19 remains consistent relative to the carriage.

Figure 4:
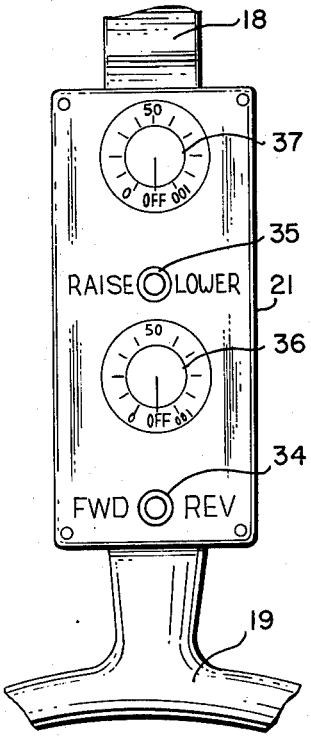
FIG. 4 is a front elevational view of a manual control panel for the walker of FIG. 1.

Referring now to FIG. 4, there is shown in full front view the control panel 21 referred to in FIG. 1. Essentially, there is provided a first manually operable push-button switch 34 connected to the first motor 22 of FIG. 2 for energizing the same. A second push-button switch is shown at 35 in FIG. 4 which functions to operate the second motor 31 to raise or lower the support 19 at the lower end of the telescoping column. Control knobs 36 and 37 are respectively associated with the first and second motors to vary their speed as well as reverse their directions. By locating the control panel 21 adjacent to the support 19, it is in readily accessible position for operation by the patient himself when using the walker, all as will be evident by reference again to FIG. 1.

Figure 5:
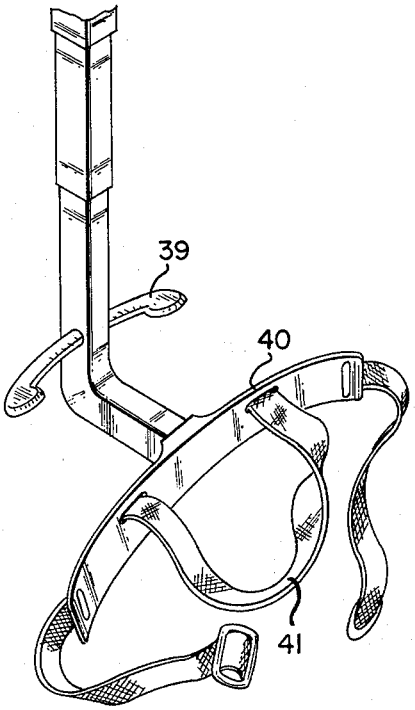
FIG. 5 is a fragmentary perspective view of a modified type of support means which could be incorporated in the walker of FIG. 1.

While the support 19 shown clearly in FIG. 1 comprises merely laterally extending handle portions for gripping by the patient's hand, in severely disabled patients or elderly people, it is possible to provide a modified support means which will provide superior support to the patient. This modified support means is illustrated in FIG. 5 and includes laterally extending hand grips 39 and in addition, a front curved bar 40 supporting a strap 41. The strap 41 is arranged to be wrapped about the mid-section of the patient under the patient's arms and thus provide bodily support. It will be understood that this type of support means could be substituted for the support means 19 of FIG. 1.

OPERATION

In operation, an attendant or a patient himself if capable would adjust the height of the support 19 relative to the floor at a convenient level in accord with the patient's height for easy manual holding. This adjustment is effected by operating the push-button 35 and the control knob 37 to energize and rotate the second motor 31 in a direction to either raise or lower the support. Thereafter, the patient can energize the first motor by means of the push-button switch 34 and adjust the speed of operation as well as the direction of rotation by the knob 36. The carriage 15, column means 16 and support 19 are thus all moved as a unit along the track 13 thereby aiding the patient or elderly person in walking along the prescribed path.

In the particular illustration of FIG. 1, the track 13 is shown passing into different rooms connected to the room 10 through doorways. It will be noted that the upper central portions of the door sills have been removed to accommodate the track 13 and the carriage and upper portion of the column when the patient is travelling from one room to the other.

The foregoing is thus illustrative in one sense of a system which might be incorporated in an elderly person's home to aid him in moving from one area to another area.

After a patient is through walking, he can stop the walker by utilizing the push-button 34 or if desired, he can reverse the direction to return to a given location by means of the knob 36.

As stated heretofore, if the patient is severely disabled, he can be provided with greater support by means of the modified support means illustrated in FIG. 3 wherein the strap 41 would then be looped about the patient under his arms to provide the necessary support.

While in many instances a patient or elderly person can utilize the electric walker as described completely by himself, the services of a therapist are not necessarily ruled out. In severe cases of crippled persons, the therapist can still assist but the task is greatly facilitated with the electrical walker available as described.

From the foregoing description, it will thus be evident that the present invention has provided an important and needed therapeutic device all to the end that patients and elderly persons can learn to walk or rework the necessary walking muscles when recovering from a disabling malady.

What is claimed is:

1. An electric walker for aiding a patient to walk along a given path on the floor of at least one room having a ceiling, comprising, in combination:

a. an overhead track means secured to the ceiling vertically above said given path and following the direction of said path;

b. a carriage having roller means engaging said track means so that said carriage can move along said track means;

c. telescoping column means including a first hollow elongated member secured at its upper end to said carriage and at least one additional hollow elongated member telescopically received in the lower end of said first member and extending vertically downwardly to terminate at its lower end in support means at a selected level above said floor, said first member and additional member being square in cross section so that they are keyed against rotation relative to each other so that said support means remains in a consistent orientation relative to said carriage;

d. a first electric motor supported by said carriage and coupled to said roller means for driving said roller means when energized to thereby positively move said carriage along said track means in either direction;

e. a second reversible electric motor supported by said carriage and connected to said column means for telescopically operating said column means in either direction when energized to extend or retract the same; and, f. manually operable motor control means secured to the lower end of said column means adjacent to said support means for energizing said first and second motors respectively whereby the patient may be supported by said support means and aided in movement along said path by said first motor, said manually operable motor control means further including means for varying the speed of said first motor so that a patient can adjust the speed at which he walks while supported by said support means.

2. An electric walker according to claim 1, in which said roller means include horizontally spaced rollers; a shaft extending between said rollers and secured thereto for rotation with said rollers; and a spur gear secured to said shaft midway of said rollers, said first electric motor having a vertical drive shaft terminating in a worm gear in meshing engagement with said spur gear so that rotation of said drive shaft rotates said spaced rollers.

3. An electric walker according to claim 1, in which said second motor includes a downwardly extending threaded shaft, said first hollow elongated member and additional member surrounding said threaded shaft; and a travelling nut on said threaded shaft secured to said additional member so that rotation of said threaded shaft in one direction or the other will extend or retract said additional member relative to said first member.

4. A walker according to claim 1, in which said support means comprises handle means which are gripped by the patient's hand when using the walker to provide support.

5. A walker according to claim 1, in which said support means includes a strap for securement under the patient's arms for providing support when using the walker.

* * * * *